United States Patent [19]

Brinkman

[11] Patent Number: 4,766,750

[45] Date of Patent: Aug. 30, 1988

[54] CONTROL MECHANISM FOR THREAD ROLLING ATTACHMENT

[75] Inventor: Robert J. Brinkman, Rochester, N.Y.

[73] Assignee: C. J. Winter Machine Works, Rochester, N.Y.

[21] Appl. No.: 133,135

[22] Filed: Dec. 14, 1987

[51] Int. Cl.[4] ..... B21H 3/04

[52] U.S. Cl. ..... 72/30; 72/104; 91/400

[58] Field of Search ..... 72/30, 104, 108; 91/342, 394, 395, 400, 410

[56] References Cited

U.S. PATENT DOCUMENTS

| | | | |
|---|---|---|---|
| 3,132,566 | 5/1964 | Dinkelkamp | 91/342 |
| 4,224,858 | 9/1980 | Tsuchiyama | 91/410 |
| 4,383,475 | 5/1983 | Quarve | 91/342 |
| 4,617,816 | 10/1986 | Brinkman | 72/104 |

*Primary Examiner*—Lowell A. Larson

*Attorney, Agent, or Firm*—Shlesinger, Fitzsimmons & Shlesinger

[57] ABSTRACT

The wedge-shaped operating member of a thread rolling attachment is reciprocated by a piston rod which extends into one end of a fluid pressure cylinder. A rotatable valve stem is mounted intermediate its ends in the opposite end of the cylinder for limited axial movement, and has thereon a valve seat normally closing a port which leads to a reversible valve that directs fluid under pressure selectively to opposite ends of the cylinder to shift the piston rod between retracted and advanced positions. The inner end of the stem is slidably connected to the piston rod so that when the latter reaches its advanced position it momentarily unseats the valve seat from the port to effect reversal of the valve and consequent return of the piston rod. The valve stem is rotatable to adjust the length of the stroke of the piston rod.

10 Claims, 2 Drawing Sheets

CONTROL MECHANISM FOR THREAD ROLLING ATTACHMENT

BACKGROUND OF THE INVENTION

Figure 1:
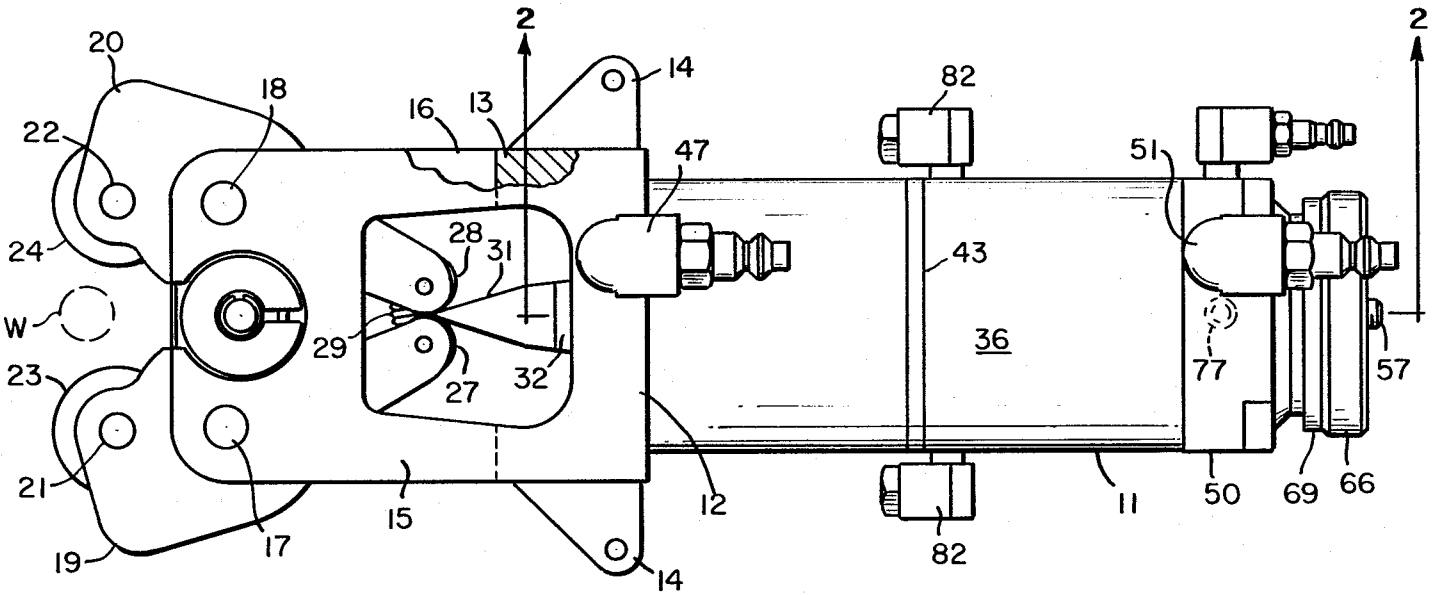

This invention relates to thread rolling attachments for screw machines, and more particularly to improved means for controlling the operation of such attachments.

U.S. Pat. No. 4,617,816, which is assigned to the same assignee as this application, discloses a thread rolling attachment having a fluid pressure operated control mechanism for swinging a pair of cooperating threading rolls into and out of operative engagement with the periphery of a piece of rotating bar stock in an automatic screw machine. The threading rolls are carried on the operating ends of a pair of pivotally mounted arms, the opposite ends of which are spring-loaded in a direction normally to maintain the threading rolls disengaged from the work that is to be threaded. A fluid pressure operated piston moves a wedge-shaped operating element between the spring-loaded ends of the arms selectively to cause the arms to pivot the threading rolls into engagement with the work.

While the thread rolling attachment disclosed in the above-noted U.S. Pat. No. 4,617,816 functions effectively for the purpose intended, it is an object of this invention to provide therefor an improved fluid pressure control mechanism which is substantially less complicated, and thus more inexpensive to manufacture and easier to assemble.

Still another object of this invention is to provide for a fluid pressure operated thread rolling attachment of the type described an improved control mechanism which permits more reliable adjustment of the mechanism, and which minimizes the possibility of its failure during use.

Other objects of the invention will be apparent hereinafter from the specification, and from the recital of the appended claims, particularly when read in conjunction with the accompanying drawings.

SUMMARY OF THE INVENTION

The pivotal thread roll supporting arms of a thread rolling attachment carry at one end a pair of threading rolls, and are engagable at their opposite ends by a wedge-shaped operating member, which is attached to the outer end of a reciprocable piston rod that projects from one end of a fluid pressure cylinder. An adjusting screw, which is mounted for limited axial movement in an axial bore formed in an end plate that closes the opposite end of the cylinder, has a threaded inner end that projects into a rectangular bore in the inner end of the piston rod, and has adjustably threaded thereon a rectangular nut that is slidable axially in the rectangular bore of the rod when the latter is reciprocated.

Normally, a circular collar or flange on the adjusting screw is held resiliently and sealingly against an annular chamber, which is formed around a reduced diamtere portion of the adjusting screw in the axial bore of the end plate in which the screw is mounted. This chamber communicates through a radial port in the cylinder end plate with a reversing valve which is located externally of the attachment.

In use, fluid under pressure is admitted through an inlet port in the above-note end plate causing a piston on the rod to advance the rod and attached wedge member forwardly until a cap nut on the inner end of the rod strikes the rectangular nut on the adjusting screw, thus causing the screw to be advanced slightly against the resistance of spring means, thereby momentarily withdrawing the collar or flange on the screw away from sealing engagement with the chamber in the end plate. This permits fluid under pressure to enter the chamber and to pass through the port in the end plate to actuate the reversing valve, which in turn causes the adjacent end of the cylinder bore to be connected to an exhaust sump, while at the same time supplying fluid pressure to the opposite end of the cylinder to shift the piston and attached rod back to their retracted positions. The returning piston rod causes its cap nut to strike the collar on the adjusting screw to assist the resilient means in returning the collar to its closed position over the annular chamber.

THE DRAWINGS

Figure 2:
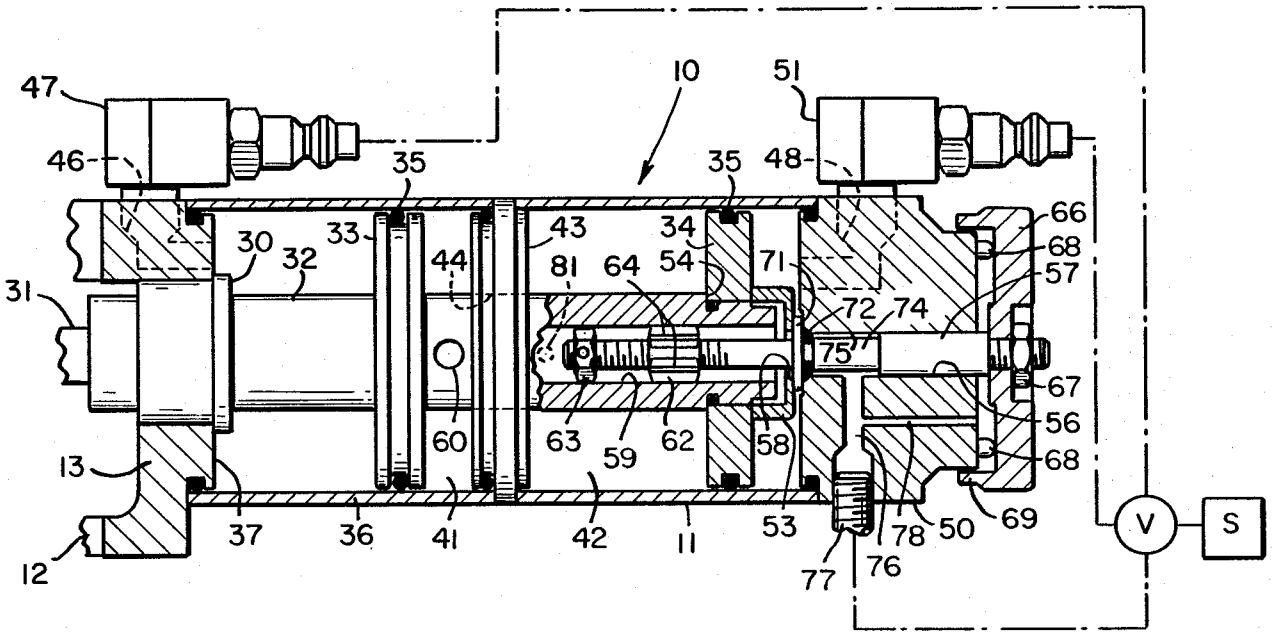

FIG. 1 is a side elevational view of a thread rolling attachment having an improved control mechanism therefor made according to one embodiment of this invention, and with part of the attachment broken away and shown in section; and FIG. 2 is an enlarged, fragmentary sectional view of the attachment taken generally along the line 2—2 in FIG. 1 looking in the direction of the arrows, and with portions thereof shown in full.

PREFERRED EMBODIMENTS OF THE INVENTION

Referring now to drawings with numerals of reference, 10 denotes generally a thread rolling attachment comprising an operating cylinder 11, which is secured at its forward end to the rear or end wall 13 of a roll arm yoke 12. Yoke 12 has projecting from opposite sides of its closed end a pair of brackets 14 for use in securing the attachment 10 in a screw machine, or the like. Projecting forwardly from its closed end the yoke 12 has a pair of spaced, parallel arms 15 and 16 between which extend a pair of roll arm supporting pins or shafts 17 and 18. Pivotaly mounted intermediate their ends on the pins 17 and 18 to rotate between the yoke arms 15 and 16 are two thread roll supporting arms 19 and 20, respectively.

Rotatably mounted by pins 21 and 22 in the forward ends of the arms 19 and 20 are two conventional threading rolls 23 and 24, respectively. Rotatably mounted in recesses at the rear ends of the thread roll supporting arms 19 and 20 are two wedge engaging rollers 27 and 28, respectively. The rear ends of the arms 19 and 20 are also connected by a tension spring 29, which normally retains the arms 19 and 20 in thier open or inoperative positions as shown in FIG. 1, whereby their threading rolls 23 and 24 are disengaged or spaced from the rotating work or bar stock, which is shown by broken lines at W in FIG. 1.

The rollers 27 and 28 are engageable by the forward, tapered end of a generally wedge-shaped operating element 31, the rear end of which is fastened to the forward end of a piston rod 32 which, as shown more clearly in FIG. 2, projects slidably at its forward end through a bearing 30 that is secured in a central opening in the rear wall 13 of the yoke 12. As thus far described, the threading attachment is generally similar to that described in the above-noted U.S. Pat. No. 4,617,816.

In accordance with the present invention, the piston rod 32 has secured coaxially thereon a pair of axially spaced pistons 33 and 34, rather than the single piston disclosed in the above-noted patent. Each of the pistons 33 and 34 has secured in an annular recess in its outer periphery a conventional O-Ring, which has resilient, sliding engagement with the inner peripheral surface of an elongate, metal sleeve 36, which forms the tubular housing of cylinder 11. At its forward or left end (FIG. 2) the sleeve 36 is sealingly secured coaxially about a cylindrical boss 37, which is integral with, and projects rearwardly from the closed end 13 of yoke 12 coaxially of the annular bearing 30.

Intermediate its ends the sleeve 36 is divided into two separate chambers 41 and 42 by a circular, generally disc-shaped baffle plate 43, which is secured in the sleeve 36 intermediate its ends, and coaxially about the piston rod 32, which slides sealingly and coaxially through a central opening 44 in plate 43. Plate 43 is positioned between the pistons 33 and 34, so that piston 33 reciprocates in the chamber 41, while the piston 34 reciprocates in chamber 42. As noted in greater detail hereinafter, fluid under pressure is supplied to and exhausted from the chamber 41 forwardly of, or to the left side of piston 33, via a right angular duct or port 46, which is formed in the end wall 13 of yoke 12 to communicate at its inner end with the chamber 41, and at its outer end through a conventional, tubular elbow fitting 47 with a first port in conventional flow control valve shown schematically at V in FIG. 2. Similarly, fluid under pressure is supplied to and exhausted from the chamber 42 by a right-angular duct or port 48, which is formed in an end plate or cap 50 that is secured to and closes the end of sleeve 36 remote from the yoke 12. Port 48 communicates at its inner end with chamber 42 and at its outer end through a conventional elbow fitting 51 with a second port in the control valve V by conventional means illustrated only schematically by the broken line in FIG. 2.

As shown more clearly in FIG. 2, the piston 34 is secured to the right or inner end of the piston rod 32 by an annular cap nut 53, which threads over the inner end of rod 32 in order to secure the piston 34 snugly against a circumferential shoulder 54, which is formed on rod 32 intermediate its ends.

Rotatably mounted adjacent one end thereof in an axial bore 56 in the cylinder end cap 50 is an elongate adjusting screw 57, which extends at its inner end through a central opening 58 in the cap nut 53, and into an axial bor 59 formed in the rear end of the piston rod 32. This bore 59 is generally rectangular in corss-section, and communicates at one end through an opening 60 in the wall of the piston rod with the chamber 41. Adjustably mounted on the externally threaded inner end of screw 57 is a rectangularly shaped adjusting nut 62, which has an outer, rectangularly shaped peripheral surface that has axial sliding engagement with the rectangularly shaped bore 59 in piston rod 32. As noted in greater detail hereinafter, the axial position of the nut 62 on the threaded end of screw 57 can be adjusted simply by rotating screw 57 in one direction or the other. The extent to which nut 62 can be adjusted toward the inner, terminal end of the screw 57 is limited by a stop nut 63, which is fixedly threaded onto the inner end of screw 57. Also, nut 62 has formed at its outer peripheral surface a plurality of axially extending grooves 64, the purpose of which will be noted hereinafter.

Screw 57 projects at its outer end beyond the end plate 50, and has a reduced-diameter, externally threaded end which extends through a central opening in a circular adjusting knob 66, which is secured by a nut 67 to the threaded, outer end of screw 57 to be supported thereby in slightly spaced, axial relation to the outer end of the end plate 50. The knob 66 has in its inner surface a plurality of spaced dimples or recesses, which are disposed to register with the rounded heads of a plurality of spring-loaded detents 68, which are mounted in the outer end of end plate 50 in a manner similar to the detents disclosed in the above-noted U.S. Pat. No. 4,617,816. Unlike the adjusting knob in the above-noted patent, however, the knob 66 also has an integral, annular skirt portion 69, which extends axially over, and surrounds, a marginal end portion of the plate 50 for a purpose noted hereinafter.

Intermediate its ends the screw 57 has thereon an integral, enlarged-diameter flange or should 71, which overlies the outer or right end of the cap nut 53, and which is disposed to seat in a circular, registering recess formed in the inner end (left end in FIG. 2) of the end plate 50 coaxially of its bore 56. In this position the shoulder 71 on screw 57 operatively seals the inner end of bore 56 from chamber 42. to insure that this seal is complete, a resilient O-ring 72 is mounted in a reduced-diameter, annular recess formed in the screw 57 immediately to the right of shoulder 71 as shown in FIG. 2, so that the O-ring 72, in combination with the shoulder 71, seals off the inner end of bore 56. This seal is important, because as also shown in FIG. 2, the screw 57 has formed thereon adjacent the inner end of bore 56 another, slightly reduced diameter, axially extending portion 74, which forms an annular chamber or recess 75 in bore 56 between the central portion of screw 57, and the O-ring 72. This annular recess 75 communicates through a radial port 76 in the end plate 50, and through a tubular pipe fitting 77 with a third port in the control valve V. The radial port 76 also communicates intermediate its ends with an axial duct 78, which is formed in the end plate 50 to open at one end on port 76, and at its opposite end on the outer, end face of plate 50, and beneath the adjusting knob 66 for a purpose noted hereinafter.

In use, when it is desired to advance the wedge element 31 to an operative position in which it swings the thread rolls 23, 24 into engagement with the work W, fluid under pressure is supplied from a source S (FIG. 2) through the valve V and fitting 51 to the port 48, and thus to chamber 42 in cylinder 11 rearwardly or the right of piston 34 as shown in FIG. 2. At the time that this occurs, the valve V, in a conventional manner, causes port 46 in the opposite end of the cylinder to be exhausted through element 47 to atmosphere or to a sump, depending upon the type of fluid employed. The fluid under pressure that is admitted to chamber 42 rearwardly of piston 34 causes this piston, and hence rod 32, to begin shifting to the left from the position as shown in FIG. 2. As soon as this occurs the cap nut 53 disengages the shoulder 71 on the screw 57, which at this time remains resiliently seated against plate 50 by virtue of the spring-loaded detents 68, so that the annular space 75 in bore 56 of plate 50 remains sealed by the O-ring 72.

The central opening 58 in the cap nut 53 is slightly greater in diameter than the portion of the screw 57 which extends therethrough, so that as soon as the nut 53 moves away from the shoulder 71 the fluid under pressure entering the chamber 42 is allowed to pass into the bore 59 in the rear end of rod 32, axially through the grooves or slots 64 in the nut 62, and out of the radial opening 60 in rod 32, and into the chamber 41 to the rear or right side or piston 33 as shown in FIG. 2. Consequently, the incoming pressurized fluid operates against the rear surfaces of both the pistons 34 and 33, thereby causing the rod 32 to shift or advance toward the left in FIG. 2, and in turn causing the wedge element 31 to advance and swing the roller arms 19 and 20 to their operative positions. As piston 34 moves toward the left, fluid in chamber 42 to the left of this piston is exhausted through opposed vents or ports 81 in the sleeve 36. Each vent 81, only one of which is shown in FIG. 2, communciates through one of two conventional muffler elements 82 (FIG. 1), which are mounted on opposite sides of the sleeve 11.

When the piston rod 32 has advanced a predetermined distance toward the left in FIG. 2, the portion of the cap nut 53 containing the opening 58 eventually engages the nut 62, thereby causing the screw 57 to be shifted slightly axially toward the left in FIG. 2 against the resistance of the spring-loaded detents 68, thereby also causing the shoulder or flange 71 to disengage plate 50, and withdrawing the O-ring from the inner end of bore 56. As soon as this happens the fluid under pressure then in chamber 42 is permitted to enter the annular space 75 in bore 56, and thus allows fluid under pressure to pass through port 76 to the valve V, and also permits some of this fluid to pass through duct 78 to the space beneath the adjusting knob 66. The fluid under pressure from port 76 is applied to a pilot valve, or the like, contained within the control valve V, so that valve V is now reversed or otherwise caused to shift to a position in which fluid under pressure is supplied to port 46, while port 48 at the opposite end of the cylinder 11 is exhausted to a sump, or the like.

The fluid under pressure now entering chamber 41 to the left of piston 33 causes this piston to be returned toward the right to its retracted position as shown in FIG. 2, thereby at the same time causing piston 34 also to return to its retracted position (FIG. 2). During this time the spring-loaded detents 68 urge screw 57 back to its original position, whereby the inner end of the bore 56 in the end plate 50 is once again closed by the O-ring 72, and the cap nut 53 on rod 32 once again comes to rest against the collar 71 on screw 57. This effectively removes pressure from the port 76, thus permitting the valve V to return to its original position in which it is once again ready to advance the pistons 33 and 34 to operate the thread rolling attachment.

As in the case of the control mechanism shown in U.S. Pat. No. 4,617,816, the position of nut 62 on the inner end of screw 57 may be adjusted simply by rotating knob 66 and hence screw 57 either clockwise or counterclockwise into one of the various positions in which it can be retained releasably by the spring-loaded detents 68.

One of the primary advantages of applicant's improved control mechanism is that, by utilizing the integral shoulder 71 on screw 57, a more reliable and easier to assembly mechanism is achieved, as compared to the mechanism disclosed in the above-noted U.S. patent. Moreover, by utilizing port 76 in combination with the shoulder 71 and O-ring 72, which normally keep port 76 sealed off from the interior of the cylinder 11, it is possible to eliminate a rather costly pilot valve mechanism heretofore mounted in the end plate 50. Instead, the adjusting screw 57 itself acts as a reversing valve by selectively admitting fluid under pressure to the port 76. Thus, simply by relying upon the movement of the screw 57, it has been possible to eliminate other, rather expensive valve parts which heretofore had to be specially manufactured and mounted in the attachment for operation by the adjusting knob 66.

Still another advantage of this improved mechanism is that the adjusting knob is provided with a skirt 69, which overlies the outer end of plate 50, and thus prevents any undesirable accumulation of cutting chips or turnings in the space between the knob 66 and the outer end of plate 50. This protection is supplemented by exhausting some of the fluid under pressure through the duct 78 upon return of the piston rod 32 to its retracted position. This feature is particularly advantageous when the fluid under pressure is compressed air.

From the foregoing, it will be apparent that the present invention provides for thread rolling attachments of the type described a substantially more compact, reliable and inexpensive control mechanism, as compared to prior such mechanisms. The improved mechanism not only is easy to assemble and operate, but also is less prone to failure, in view of the utilization of the integral shoulder 71 on the screw 57, as compared to pripr devices which tended to utilize removable, C-shaped spring clamps for this purpose. Moreover, although the novel control mechanism has been shown to be employed in combination with a cylinder employing dual pistons 33, 34 on rod 32, it obviously may be used to equal advantage with a cylinder employing a single piston, in which case the baffle plate 43 could be eliminated. Also, of course, the threading rolls may be any form of pattern rolls capable of forming a pattern in the periphery of the work W.

While this invention has been illustrated and described in detail in connection with only certain embodiments thereof, it will be apparent that this application is intended to cover any such modifications as may fall within the scope of one skilled in the art or the appended claims.

I claim:

1. In a thread rolling attachment have a reciprocable operating element for selectively swinging a pair of pattern rolls into engagement with a rotating workpiece, and a fluid pressure cylinder having a piston rod reciprocable at one end in an axial bore in said cylinder between retracted and advanced positions, and projecting at its oposite end slidably out of one end of said cylinder to engage and inpart reciprocation to said operating element, an improved mechanism for controlling the flow of fluid under pressure to said cylinder, comprising reversible valve means connected to a first plurality of ports in said cylinder and operable selectively to supply fluid under pressure from a supply thereof alternately to opposite ends of said cylinder, thereby to effect reciprocation of said piston rod, said cylinder having in the opposite end thereof a further port opening at one end on the bore in said cylinder and connected at its opposite end to said valve means to effect reversal thereof when fluid under pressure is supplied to said further port from the bore in said cylinder, a valve stem movable mounted in said opposite end of said cylinder and having thereon a valve seat normally closing said one end of said further port when said piston rod is in its retracted position, and means connecting said valve stem to said piston rod and operative, when said piston rod has moved to its advanced position, momentarily to shift said valve stem and said valve seat in a direction to open said one end of said further port, thereby to admit fluid under pressure from said cylinder bore to said valve means to reverse the latter.

2. A thread rolling attachment as defined in claim 1, wherein said means connecting said valve stem to said piston rod includes means for adjusting the distance said piston rod must advance in said cylinder before causing said valve stem to open said one end of said further port.

3. A thread rolling attachment as defined in claim 1, wherein said valve stem is mounted intermediate its ends for rotational and limited axial movement in said opposite end of said cylinder, and projects at one end thereof into said bore in said cylinder coaxially of said piston rod, resilient means is interposed between said valve stem and said cylinder normally to retain said stem in a first position in which said valve seat is positioned sealingly over said one end of said further port, when said piston rod is in its retracted position, and said connecting means slidably connects said one end of said stem to said one end of said piston rod to permit limited axial movement of said rod relative to said stem, and is operative momentarily to move said stem against the resitance of said resilient means when said rod reaches its advanced position.

4. A thread rolling attachments as defined in claim 3, wherein said one end of said stem projects slidably into a rectangularly shaped blind bore in said one end of said piston rod, and has a nut threaded thereon for adjustment axially in said rectangular bore upon rotation of said stem, and a shoulder is formed on said piston rod adjacent the outer end of said blind bore to be spaced from said nut on said stem when said piston rod is in its retracted position, and disposed to strike said nut when said rod is moved to its advanced position.

5. A thread rolling attachment as defined in claim 3 wherein the opposite end of said stem projects axially beyond said opposite end of said cylinder, a knob is secured to said opposite end of said stem to be supported thereby in spaced confronting relation to the external surface of said cylinder at said opposite end thereof, and said knob has thereon an integral, circumferential flange which surrounds and overlaps a portion of said opposite end of said cylinder.

6. A thread rolling attachment as defined in claim 5, wherein said opposite end of said cylinder has therein an additional port opening at one end on said further port and at its opposite end on the exterior of said cylinder beneath said knob.

7. A thread rolling attachment as defined in claim 1, wherein said valve stem is mounted intermediate its ends in an end plate, which is secured to said opposite end of said cylinder to close the adjacent end of said axial bore, said further port including an annular space formed in said end plate to surround said stem, and opening at one end on said axial bore in said cylinder, and opening adjacent its opposite end on one end of a radial duct formed in said end plate and connected at its opposite end to said valve means, and said valve seat normally being positioned to seal said one end of said annular space.

8. A control mechanism for the reciprocable operating element of a thread rolling attachment, comprising a fluid pressure operated cylinder having therein a piston rod reciprocable between retracted and advanced postions, respectively, and projecting at one end from one end of said cylinder to engage and reciprocate said operating element, a rotatable valve stem mounted intermediate its ends in the opposite end of said cylinder for limited axial movement into and out of a position of rest, said cylinder having a pair of ports in said opposite end thereof, one of said ports disposed to deliver fluid under pressure from a supply thereof to said opposite end of cylinder to effect the shifting of said piston rod from its retracted to its advanced position, and the other of said ports disposed to deliver fluid under pressure from within said cylinder to a fluid reversing valve at the exterior of said cylinder, a valve set carried by said valve stem and normally closing said other port when said valve stem is in its position of rest, and means connecting said valve stem to said piston rod and operative, when fluid pressure in said cylinder moves aid piston rod to its advanced position, to shift said valve stem and its seat in a direction to open said other port, thereby to deliver fluid under pressure from said cylinder to said reversing valve, thereby to reverse the flow of fluid under pressure from said opposite end to said one end of said cylinder.

9. A control mechanism as defined in claim 8, wherein said connecting means includes means operative upon rotation of said valve stem to adjust the length of the stroke of said piston rod.

10. A control mechanism as defined in claim 8, where said other port opens at one end on the interior of said cylinder around the outside of said valve stem, and said valve seat is an integral, external shoulder formed on said stem intermediate the ends thereof, and disposed to overlie and close said one end of said other port when said valve stem is in its position of rest.

* * * * *